US006463599B1

(12) United States Patent
Perthu

(10) Patent No.: US 6,463,599 B1
(45) Date of Patent: Oct. 15, 2002

(54) CABINET SHOWER

(76) Inventor: Michael Perthu, Emdrupvej 22, DK-2100 Copenhagen (DK)

( * ) Notice: Subject to any disclaimer, the term of this patent is extended or adjusted under 35 U.S.C. 154(b) by 0 days.

(21) Appl. No.: 09/582,075

(22) PCT Filed: Dec. 22, 1998

(86) PCT No.: PCT/DK98/00579

§ 371 (c)(1),
(2), (4) Date: Apr. 18, 2001

(87) PCT Pub. No.: WO99/34718

PCT Pub. Date: Jul. 15, 1999

(30) Foreign Application Priority Data

Dec. 22, 1997 (DK) ..... 1503/97

(51) Int. Cl.[7] ..... A47K 3/28
(52) U.S. Cl. ..... 4/599; 4/603; 4/610
(58) Field of Search ..... 4/599, 602, 603, 4/610, 558

(56) References Cited

U.S. PATENT DOCUMENTS

| | | | | | |
|---|---|---|---|---|---|
| 112,217 | A | * | 2/1871 | Brown | 4/603 |
| 298,585 | A | * | 5/1884 | Horning | 4/599 |
| 1,545,093 | A | * | 7/1925 | Gallob | 4/610 X |
| 1,844,038 | A | | 2/1932 | Hooker | 4/599 |
| 2,519,430 | A | * | 8/1950 | Brown | 4/599 X |
| 2,852,784 | A | | 9/1958 | Winkler | 4/599 |
| 3,600,720 | A | | 8/1971 | Marschall | 4/599 |
| 3,606,618 | A | | 9/1971 | Veech | 4/603 |
| 3,629,875 | A | | 12/1971 | Dow | 4/599 |
| 3,646,618 | A | | 3/1972 | Johnson | 4/599 |
| 3,925,828 | A | | 12/1975 | Kim | 4/599 |
| 4,432,103 | A | | 2/1984 | Hunziker | 4/597 X |
| 4,975,992 | A | | 12/1990 | Patterson et al. | 4/599 |
| 5,293,654 | A | | 3/1994 | Castwall et al. | 4/602 X |

FOREIGN PATENT DOCUMENTS

| | | |
|---|---|---|
| DE | 1 291 483 | 3/1969 |
| DE | 2 036 274 | 1/1972 |
| FR | 379 536 | 11/1907 |
| FR | 1 513 026 | 1/1968 |
| FR | 2 030 776 | 11/1970 |
| FR | 2 255 033 | 7/1975 |
| GB | 1 532 953 | 11/1978 |
| GB | 1 602 191 | 11/1981 |

* cited by examiner

*Primary Examiner*—Robert M. Fetsuga
(74) *Attorney, Agent, or Firm*—Venable; John P. Shannon; Chad C. Anderson

(57) ABSTRACT

By means of a shower cabinet (1) which can be packed up and mounted at use. It is possible to take a shower under housing conditions where there is no or cannot be established permanent bathing facilities. The shower cabinet comprises a folding covering (4) of a flexible material, and a bottom trough (3) having a bottom (10) and a side wall and made of a solid material, such as plastic or metal. In the bottom trough (3) is placed a pump (11) for successively removing water supplied to the cabinet during showering. The covering (4) is at the end opposite the bottom trough (3) connected to a cap (2) of a solid material, such as plastic or metal. The cap (2) fits the bottom trough (3) as a cover and together with this forms a box for storing the covering (4) and the rest of the equipment of the cabinet. When the cabinet (1) is to be used, the cap (2) is lifted together with the covering (4) and secured with an elastic suspension (22) on e.g. a ceiling (23), and pump (11) and shower (6) are connected with quick-release couplings (18, 19) to a tap (14) and a drain, such as a sink (15), respectively. Now, the cabinet (1) is immediately ready to be used.

16 Claims, 3 Drawing Sheets

CABINET SHOWER

Figure 1:
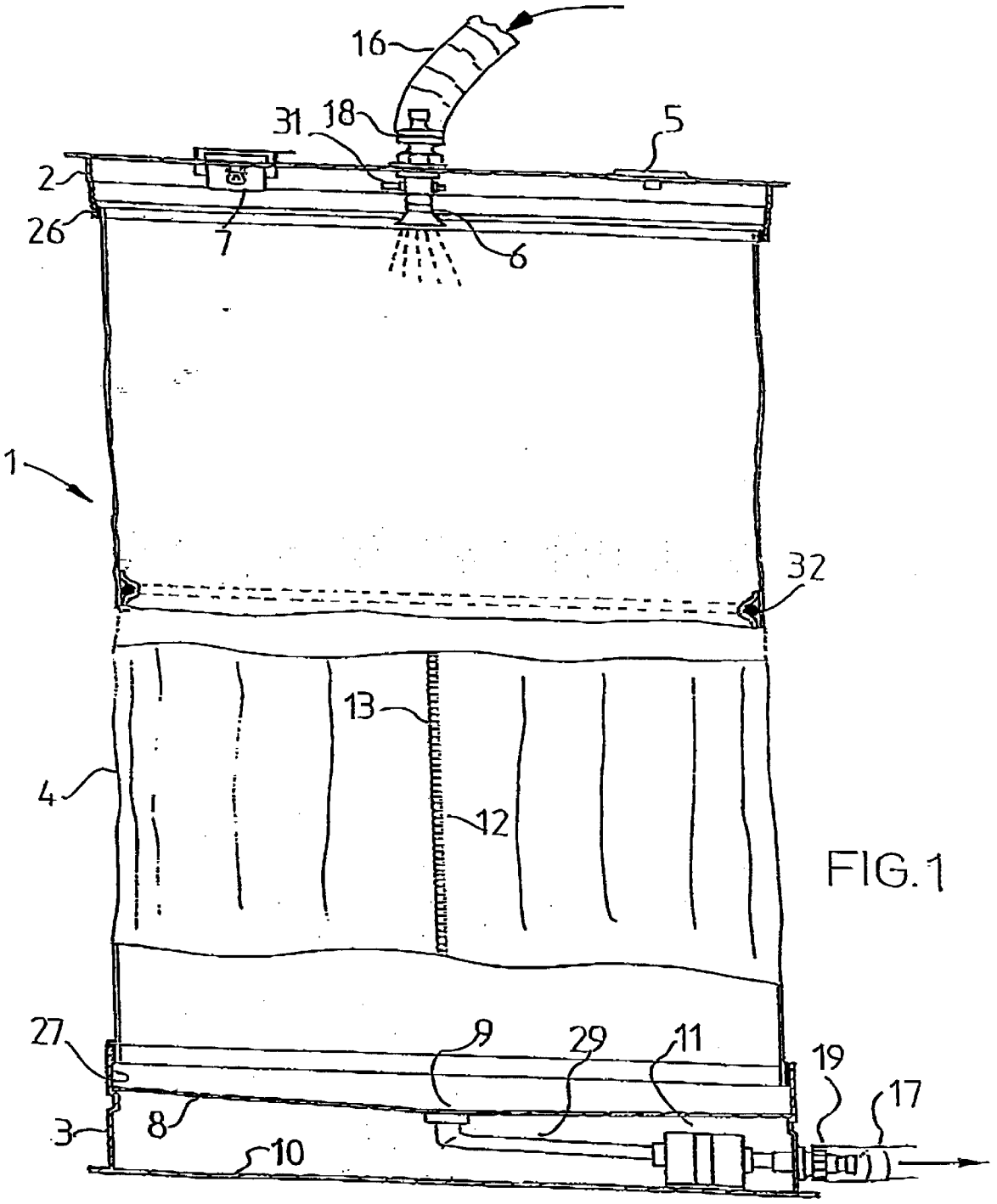

The invention relates to a shower cabinet of the kind that comprises a collapsible covering of a flexible material, and a bottom trough having a bottom and a side wall and made of a solid material, such as plastic or metal.

Many people do not have real bathing facilities in their permanent or temporary residence which e.g. can be a flat in an old building, a subleased room or a weekend cottage. Often, the conditions in these places do not permit installation of permanent bathing facilities.

The above problems have been tried being solved with a shower cabinet disclosed in the German laid-open No. 2036274 that advantageously can be stored in collapsed condition where it does not take up much space, and can easily be put up when it is to be used. Such a shower cabinet can be used under almost all circumstances. The only thing that is required is access to a drain and domestic water. The shower cabinet consists mainly of a plastic sack with a lower, about 10 cm high, reinforced part for accumulation of used water. The reinforced part is provided with a connecting piece which is closed with a plug during use. Afterwards, the plug is removed, and the water thrown out in a drain which e.g. can be a sink. The last manoeuvre is extremely difficult as it is often necessary to lift and move relatively large and heavy volumes of water. To this should be added that the cabinet is awkward to use as the sack during use must be pulled up over the user's head and then be held stretched out in a manner not specified in the laid-open.

The object of the invention is to provide a shower cabinet of the kind mentioned in the opening paragraph which is arranged in such a way that it is easier and more convenient to use than known so far.

This is according to the invention obtained by the fact that a pump is provided for successively removing water which is added to the cabinet during a shower. Immediately after the shower, the bottom trough will be emptied of water which therefore no longer have to be carried with difficulty to and thrown into a drain. After use, the cabinet can immediately be packed up so that it does not take up very much space and therefore conveniently can be kept under e.g. a bed.

The used water can be removed from the bottom trough by means of a suction pipe connected to the suction side of the pump. In order to empty the bottom trough completely of water, the used water must however be accumulated at a level which is higher up than the intake opening of the suction pipe. This is obtained by placing a floor above the suction pipe in the bottom trough and connecting the intake opening of the suction pipe to an outflow in the floor.

In order to avoid that the bather is inconvenienced by or happens to step on the suction pipe, there can above this advantageously be placed a floor which the bather can stand on.

It is an advantage to utilise the mainly empty space between the floor and the bottom of the bottom trough for placing of the pump.

In an advantageous embodiment, the covering of the cabinet can furthermore be connected to a cap of a solid material, such as plastic or metal. The cap can expediently be shaped in such a way that it fits as a cover onto the bottom trough. When this at the same time is detachably connected to the covering, the different equipment parts of the cabinet can together with the covering find room in the bottom trough which then is closed by means of the cap. Thereby, the cabinet is changed into a strong, easy to handle box which is bearably visible and easily put away.

In the cabinet disclosed in the above German laid-open No. 2036274, a handspray is used that inconveniently must be pulled through an opening in the flexible sack of this cabinet, this sack cannot in itself be used for mounting of a built-in shower. The cabinet according to the invention however can have a built-in shower with a valve fitted in the solid material of the cap so that the bather freely can use both his hands during the shower.

The solid material of the cap furthermore forms a secure anchorage for a suspension for, at mounting of the cabinet, hanging the cap with the attached covering on e.g. a ceiling. The suspension can advantageously be of the kind that elastically adjusts itself to the height of the cabinet in mounted position.

The covering has the character of a closed shower curtain which however must have one mainly longitudinal side opening for entry and exit of the bather. In order to avoid that water during showering is split or splashed on e.g. furniture and carpets, this side opening can effectively be closed by means of a zip or similar means.

Air for renewal of the air in the cabinet can be supplied via an adjustable ventilating louver. When the ventilating louver and the side opening of the covering are closed, the cabinet will quickly get warm and comfortable to enter. During bathing, the air renewal in the cabinet can also be adjusted by means of the ventilating louver in such a way that there is generated a steamy atmosphere of the kind which is liked by many bathers.

In order to quickly and easily be able to mount the cabinet and pack it up again, the shower and the pump can by means of quick-release couplings be detachably connected to each their conduit leading to a tap and a drain respectively.

In an especially advantageous embodiment, both conduits can be connected to an adapter which again is detachably connected to a tap by means of a coupling. The adapter can be in the form of a pipe with a partition wall for separating the two water flows.

Figures 2, 3:
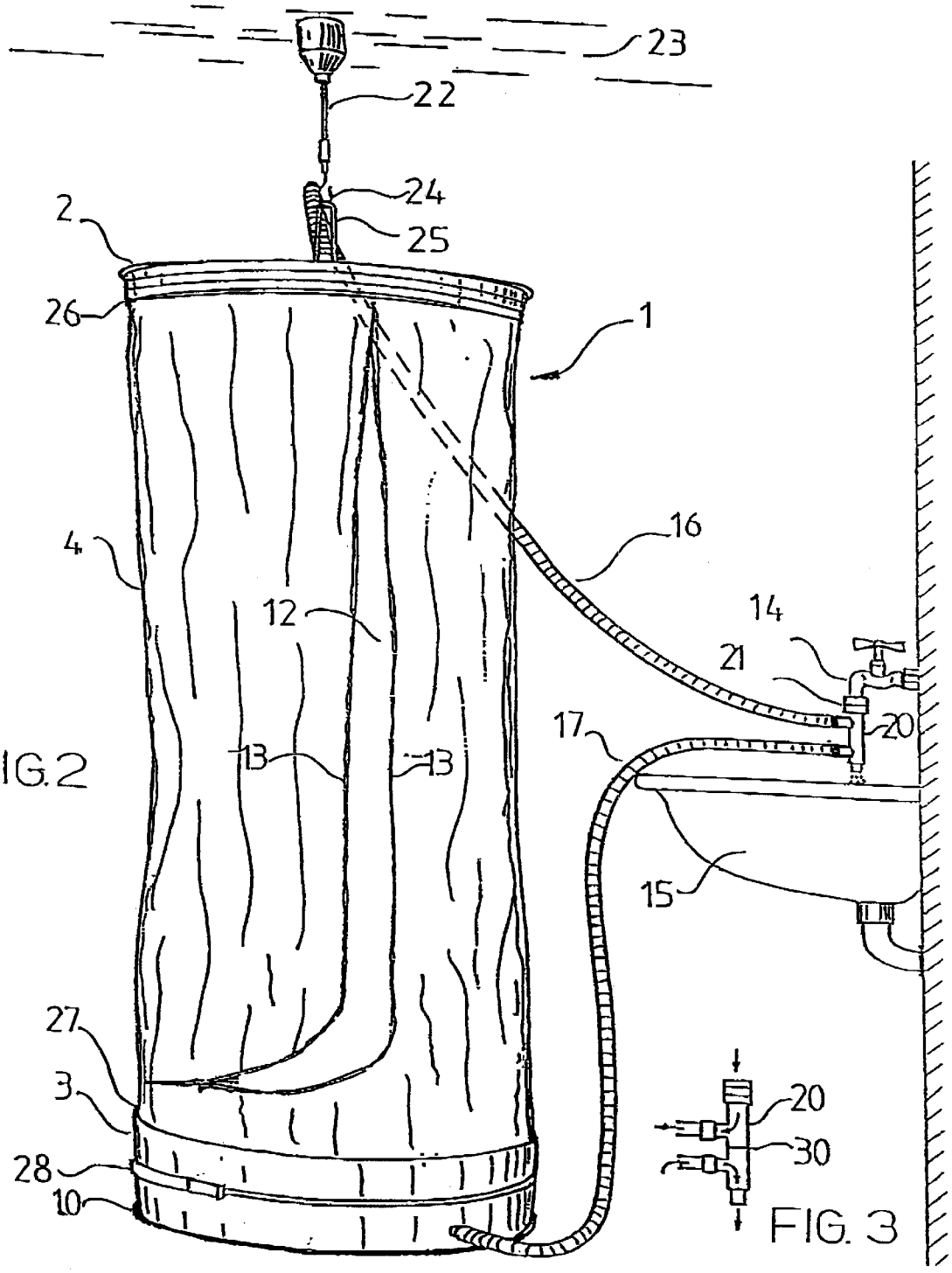
Figure 4:
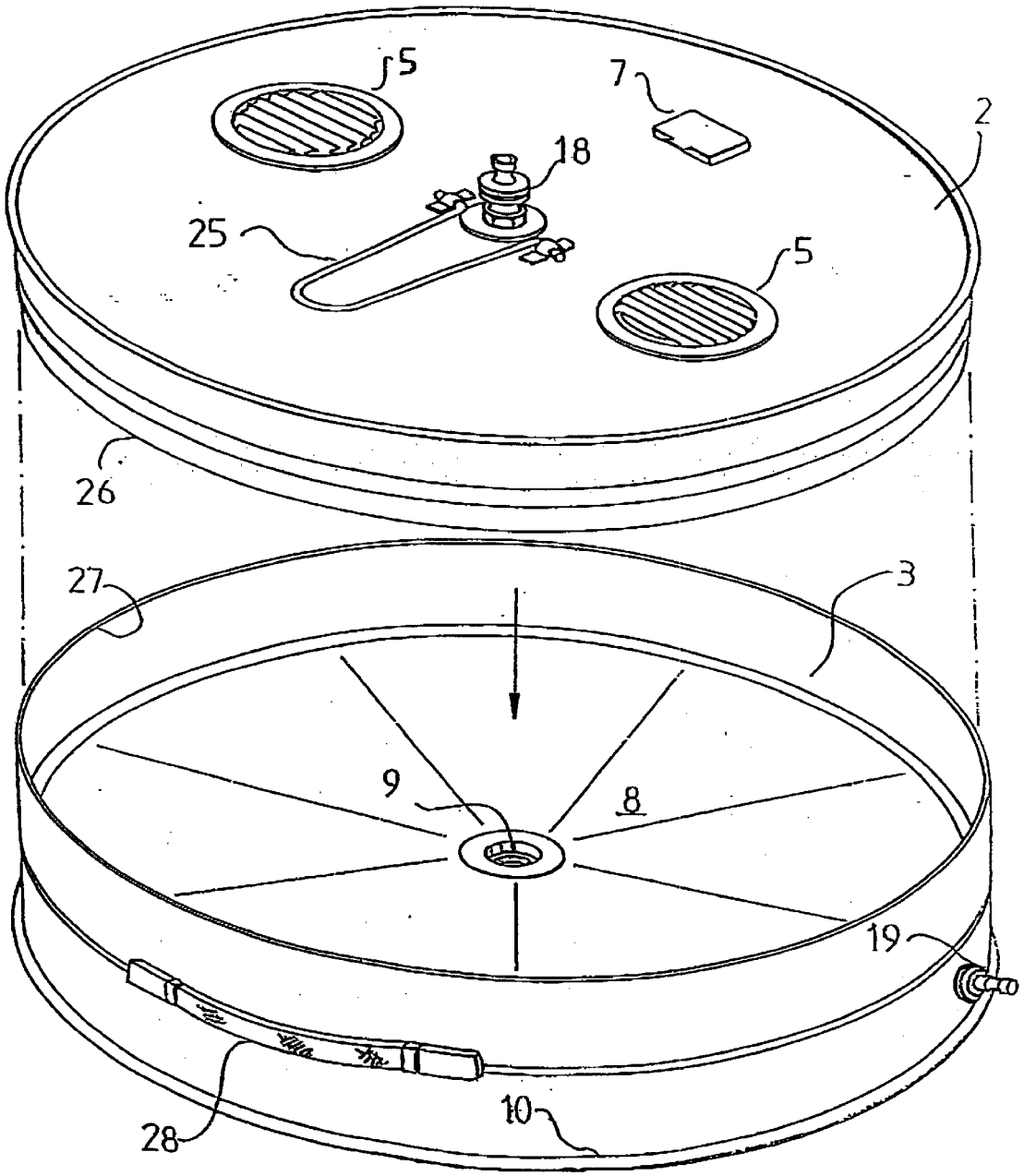

The invention will be explained in greater detail below, describing only an example of an embodiment with reference to the drawing, in which FIG. 1 is a side elevation view of a mounted shower cabinet according to the invention partly in section, FIG. 2 is a view similar to FIG. 1 but in fully mounted condition, FIG. 3 shows an adapter for simultaneously connecting the shower cabinet to a tap and a drain respectively, and FIG. 4 is on a larger scale an exploded perspective view of a bottom trough and a cap respectively for the shower cabinet shown in FIGS. 1 and 2.

FIG. 1 shows a mounted shower cabinet 1. The shower cabinet consists mainly of a cap 2, a bottom trough 3, and a covering 4. The cap 2 and the bottom trough 3 are made of a solid material, such as plastic or metal, and the covering 4 is made of a flexible material, such as plastic or a fabric. The covering 4 is firmly connected to the cap 2, and detachably connected to the bottom trough 3.

In the cap 2 is fitted two adjustable ventilating louvers 5, a shower 6, and a lamp 7. The shower 6 can conveniently be operated from inside with a valve 31 for turning on and off the water. The lamp 7 for lighting the cabinet 1 during bathing can also be switched on and off from inside.

In the bottom trough 3, a floor 8 is placed on which the bather can stand. In the floor is a discharge orifice 9, and as shown, the floor 8 is inclining towards this orifice 9.

Between the floor 8 and the bottom of the bottom trough 10, a pump 11 is placed, the suction side of which is connected to the discharge orifice 9 of the floor via a suction hose 29.

In the covering 4 is an opening 22 as passageway to the bather. In FIG. 1, the opening 12 is closed with a zip 13. As shown in FIG. 2, the opening 12 is extending mainly vertically from the cap 2 to a closed area of the covering 4 where it is ending in a mainly horizontally extending section.

As mentioned earlier, the covering 4 is made of a flexible material, and it is therefore provided with at least one elastic hoop 32 for keeping the covering 4 distended in mounted position of use. The hoop 32 is split up at the opening 12 and can therefore yield resiliently when the bather is to pass the opening.

In FIG. 2, the cabinet 1 is connected to a tap 14 and a sink 15 by means of a delivery conduit 16 and a discharge conduit 17 respectively. As best shown in FIG. 1, the delivery conduit 16 is connected to the shower 6 by means of a quick-release coupling 18, and the pump 11 to the discharge conduit 17 by means of a second quick-release coupling 19.

At the other end, the conduits 16 and 17 are connected to an adapter 20 in the form of a pipe which with a coupling 21 is detachably attached on the tap 14. When the cabinet 1 is being used, both conduits 16 and 17 are thus advantageously fixed by the tap 14.

FIG. 3 shows schematically that said adapter 20 is in the form of a pipe with a partition wall 30 for preventing the two water flows from getting mixed.

By means of the adapter 20 and the quick-release couplings 18 and 19, the conduits 16 and 17 can quickly and easily be assembled to and disassembled from the cabinet 1 and the tap 14 respectively.

FIG. 2 also shows a suspension 22 which at the upper end is secured on a ceiling 23 and at the lower end has a hook 24 hooked on a pivotal loop 25 on the cap 2. The suspension 22 is serving for keeping the cabinet 1 in an upright position and is of the kind which can elastically adjust its length depending on the floor-to-ceiling height of the place.

When the cabinet is to be used, the bather enters the cabinet through the longitudinal opening 12 (FIG. 2) of the covering, the opening is then closed by means of the zip 13 (FIG. 1). The tap 14 is turned on, and the pump 11 is started whereby water flows into the cabinet via the delivery conduit 16 and back to the sink 15 via the discharge conduit 17 as the pump 11 removes the water just as quickly as it flows in.

During showering, the bather can adjust the air renewal in the cabinet 1 by means of the ventilating louver 5. By completely or partly closing this ventilating louver, a steamy atmosphere can be generated in the cabinet 1 so that the shower is combined with a steam bath-like effect which many considers to be healthy and stimulating to the well-being.

When the cabinet 1 no longer is to be used, the conduits 16 and 17 are quickly and easily disassembled by means of the quick-release couplings 18 and 19 and the adapter 20. The bottom trough is already emptied of water.

The mentioned parts are then placed in the bottom trough 3, and the covering 4 is collapsed and also placed in the bottom trough 3, the cap 2 following in order to finally being placed as a cover on the bottom trough 3.

FIG. 4 shows in more detail how the cap 2 is shaped as a cover with a lower edge region 26 fitting into the upper edge region 27 of the bottom trough. As the covering 4 is not firmly connected to the bottom trough 3, the edge region 26 of the cap can in a fitting manner engage with the edge region 27 of the bottom trough when the cap 2 is pushed down onto the bottom trough 3 in the direction indicated by the arrow.

The bottom trough 3 and the cap 2 now form a box containing the rest of the cabinet 1, and in this condition, the cabinet 1 takes up so little space that it conveniently can be stowed away even in cramped rooms.

The box is strong and stable and can resist even rough handling. For convenient handling, it is provided with a handle 28. The box furthermore has a design which is bearably visible when it is necessary to have the box exposed to view.

The shower cabinet described above and illustrated in the drawing can be diversified in many ways within the scope of the invention.

Thus, the cap can be connected not only to the cap but also to the bottom trough but for example so far down that the edge region of the cap is permitted to fittingly engage with the edge region of the bottom trough.

In a second solution, the lower part of the covering can be detachably fastened to the inner side of the bottom trough by means of e.g. velcro strips.

The pump does not necessarily have to be placed in the bottom trough either but can also be placed outside this.

What is claimed is:

1. A shower cabinet (1) of the kind which comprises a collapsible covering (4) of a flexible material, a bottom trough (3) having a bottom (10) and a side wall and made of a solid material, such as plastic or metal, and a pump (11), characterized in that there is provided at least one elastic hoop (32) located at a central part of the collapsible covering (4) between its top and bottom, which hoop (32) distends and collapsible covering (4) in use, wherein the collapsible covering has a substantially vertical opening (12) ending at a distance from the top and the bottom, respectively, of the covering (4).

2. A shower cabinet (1) according to claim 1, characterized in that the collapsible covering (4) in use surrounds the showering area, and in that the at least one elastic hoop (32) is split at the opening (12).

3. A shower cabinet (1) according to claim 1, characterized in that the at least one elastic hoop (32) is attached to the collapsible covering (4) by being mounted in a channel which is provided between the covering (4) and extends substantially in the transverse direction of the covering (4).

4. A shower cabinet (1) according to claim 1, characterized in that a floor (8) is placed in the trough (3) at a distance from both the upper edge of the side wall and the bottom (10), and in that the pump (11) is placed in the trough (3) under the floor (8).

5. A shower cabinet (1) according to claim 1, characterized in that the floor (8) has a discharge orifice (9) which is positioned approximately halfway between the upper edge of the side wall and the bottom (10) and which via a discharge conduit (29) is connected to the inlet of the pump (11).

6. A shower cabinet (1) according to claim 1, characterized in that the outlet of the pump (11) is connected with a coupling (19) mounted on the outside of the trough (3) and adapted for connection with a waste water conduit (17).

7. A shower cabinet (1) according to claim 1, characterized in that the cabinet (1) comprises an adapter (20) for detachable mounting on a tap (14) or other domestic water outlet for thereby connecting the water supply conduit (16) with the tap (14) and supporting an outlet end of the waste water conduit (17) over a sink (15) or the like placed under the tap (14).

8. A shower cabinet (1) of the kind which comprises a collapsible covering (4) of a flexible material, a bottom trough (3) having a bottom (10) and a side wall and made of a solid material, such as plastic or metal, and a pump (11), characterized in that there is provided at least one elastic hoop (32) located at a central part of the collapsible covering (4) between its top and bottom, which hoop (32) distends and collapsible covering (4) in use, the shower cabinet further comprising a cap (2) which is made from a solid material, such as plastic or metal, and in which is mounted a shower head (6), and that the lower edge region (26) of the cap (2) fits and is connectable with the upper edge of the side wall of the trough (3) for transportation of the entire cabinet (1).

9. A shower cabinet (1) according to claim 8, characterized in that the collapsible covering (4) can be connected with the cap (2) and is detachably connected with the trough (3), such as by use of velcro strips.

10. A shower cabinet (1) according to claim 8, characterized in that the collapsible covering (4) can be connected with the bottom trough (3) at a distance from the upper edge of the side wall of the trough, so that the edge region of the cap (4) fits into the upper edge region of the bottom trough (3).

11. A shower cabinet (1) according to claim 8, characterized in that the connection between the cap (2) and the trough (3) is circular.

12. A shower cabinet (1) according to claim 8, characterized in that the collapsible covering (4) with the elastic hoop (32) is receivable in the bottom trough (3) in collapsed condition.

13. A shower cabinet (1) according to claim 8, characterized in that the inlet of the shower head (6) is connected to a coupling (18) mounted on the outside of the cap (2) and adapted for connection with a water supply conduit (16).

14. A shower cabinet (1) according to claim 8, characterized in that the cap (2) of the cabinet has at least one adjustable ventilating louver (5), and that the opening (12) of the covering (4) can be closed completely or partly by means of e.g. a zip (13).

15. A shower cabinet (1) according to claim 8, characterized in that as part of the shower cabinet is an elastic suspension (22) for connecting the cap (2) of the cabinet to e.g. a ceiling (23) at mounting.

16. A shower cabinet (1) according to claim 8, characterized in that the cabinet (1) comprises an adapter (20) for detachable mounting on a tap (14) or other domestic water outlet for thereby connecting the water supply conduit (16) with the tap (14) and supporting an outlet end of the waste water conduit (17) over a sink (15) or the like placed under the tap (14).

* * * * *